US007748708B2

(12) United States Patent
Elliot

(10) Patent No.: US 7,748,708 B2
(45) Date of Patent: Jul. 6, 2010

(54) FEEDBACK-BASED DOCUMENT HANDLING CONTROL SYSTEM

(75) Inventor: Jack Gaynor Elliot, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 186 days.

(21) Appl. No.: 11/457,944

(22) Filed: Jul. 17, 2006

(65) Prior Publication Data

US 2008/0012215 A1 Jan. 17, 2008

(51) Int. Cl.
*B65H 7/02* (2006.01)

(52) U.S. Cl. ..... 271/228; 271/227

(58) Field of Classification Search ..... 271/227, 271/226, 228

See application file for complete search history.

(56) References Cited

U.S. PATENT DOCUMENTS

| | | | | | |
|---|---|---|---|---|---|
| 4,417,150 | A | | 11/1983 | Moran | |
| 4,506,969 | A | | 3/1985 | Baker | |
| 4,511,242 | A | | 4/1985 | Ashbee et al. | |
| 4,971,304 | A | * | 11/1990 | Lofthus | 271/227 |
| 5,078,384 | A | * | 1/1992 | Moore | 271/228 |
| 5,156,391 | A | * | 10/1992 | Roller | 271/227 |
| 5,678,159 | A | * | 10/1997 | Williams et al. | 399/395 |
| 5,697,609 | A | | 12/1997 | Williams et al. | |
| 5,870,957 | A | * | 2/1999 | Muller | 101/484 |
| 5,887,996 | A | * | 3/1999 | Castelli et al. | 400/579 |
| 5,947,617 | A | * | 9/1999 | Kondo | 400/579 |
| 6,276,586 | B1 | * | 8/2001 | Yeo et al. | 226/17 |
| 7,083,167 | B2 | * | 8/2006 | Barthold | 271/228 |
| 7,193,380 | B2 | * | 3/2007 | Stout et al. | 318/373 |
| 7,258,340 | B2 | * | 8/2007 | Clark et al. | 271/228 |
| 7,306,221 | B2 | * | 12/2007 | Agata | 271/251 |
| 2003/0057637 | A1 | * | 3/2003 | Kawamura et al. | 271/227 |
| 2003/0184002 | A1 | * | 10/2003 | Akiyama et al. | 271/110 |
| 2005/0175386 | A1 | * | 8/2005 | Romine | 400/579 |
| 2005/0263958 | A1 | | 12/2005 | Knierim et al. | |
| 2006/0171725 | A1 | | 8/2006 | Ruthenberg et al. | |
| 2006/0197038 | A1 | | 9/2006 | Park et al. | |

OTHER PUBLICATIONS

Nilanjan Sarkar et al. "Control of Mechanical Systems with Rolling Constraints: Application to Dynamic Control of Mobile Robots", The International Journal of Robotics Research, vol. 13, No. 1, Feb. 1994, pp. 55-69.

Rene Sanchez et al. "Paper Sheet Control Using Steerable Nips", Department of Mechanical Engineering, University of California, Berkeley, California 2004, pp. 482-487.

* cited by examiner

*Primary Examiner*—Patrick Mackey
*Assistant Examiner*—Patrick Cicchino
(74) *Attorney, Agent, or Firm*—Pepper Hamilton LLP

(57) ABSTRACT

A method and system for performing sheet registration are disclosed. Output values for a sheet may be identified within a reference frame. A difference between each output value and a corresponding desired output value may be determined. Input values may be determined based on at least the differences. State feedback values may be determined based on information received from one or more sensors. Acceleration values may be determined for multiple drive rolls based on the input values and the state feedback values. A desired angular velocity for each drive roll may be determined based on the corresponding acceleration value. A motor voltage may be determined for each drive roll that tracks an observed angular velocity value to the desired angular velocity value. The acceleration values may create a linear differential relationship between the input values and the output values. The steps may be performed multiple times.

15 Claims, 14 Drawing Sheets

FEEDBACK-BASED DOCUMENT HANDLING CONTROL SYSTEM

BACKGROUND

1. Technical Field

The disclosed generally pertain to sheet registration systems and methods for operating such systems. Specifically, the disclosed embodiments pertain to methods and systems for registering sheets using a closed-loop feedback control scheme.

2. Background

Sheet registration systems are presently employed to align sheets in a device. For example, high-speed printing devices typically include a sheet registration system to align paper sheets as they are transported from the storage tray to the printing area.

Sheet registration systems typically use sensors to detect a location of a sheet at various points during its transport. Sensors are often used to detect a leading edge of the sheet and/or a side of the sheet to determine the orientation of the sheet as it passes over the sensors. Based on the information retrieved from the sensors, the angular velocity of one or more nips can be modified to correct the alignment of the sheet.

A nip is formed by the squeezing together of two rolls, typically an idler roll and drive roll, thereby creating a rotating device used to propel a sheet in a process direction by its passing between the rolls. An active nip is a nip rotated by a motor that can cause the nip to rotate at a variable nip velocity. Typically, a sheet registration system includes at least two active nips having separate motors. As such, by altering the angular velocities at which the two active nips are rotated, the sheet registration system may register (orient) a sheet that is sensed by the sensors to be misaligned.

Numerous sheet registration systems have been developed. For example, the sheet registration system described in U.S. Pat. No. 4,971,304 to Lofthus, which is incorporated herein by reference in its entirety, describes a system incorporating an array of sensors and two active nips. The active sheet registration system provides deskewing and registration of sheets along a process path having an X, Y and Θ coordinate system. Sheet drivers are independently controllable to selectively provide differential and non-differential driving of the sheet in accordance with the position of the sheet as sensed by the array of sensors. The sheet is driven non-differentially until the initial random skew is measured. The sheet is then driven differentially to correct the measured skew and to induce a known skew. The sheet is then driven non-differentially until a side edge is detected, whereupon the sheet is driven differentially to compensate for the known skew. Upon final deskewing, the sheet is driven non-differentially outwardly from the deskewing and registration arrangement.

A second sheet registration system is described in U.S. Pat. No. 5,678,159 to Williams et al., which is incorporated herein by reference in its entirety. U.S. Pat. No. 5,678,159 describes a deskewing and registering device for an electrophotographic printing machine. A single set of sensors determines the position and skew of a sheet in a paper process path and generates signals indicative thereof. A pair of independently driven nips forwards the sheet to a registration position in skew and at the proper time based on signals from a controller which interprets the position signals and generates the motor control signals. An additional set of sensors can be used at the registration position to provide feedback for updating the control signals as rolls wear or different substrates having different coefficients of friction are used.

In addition, U.S. Pat. No. 5,887,996 to Castelli et al., which is incorporated herein by reference in its entirety, describes an electrophotographic printing machine having a device for registering and deskewing a sheet along a paper process path including a single sensor located along an edge of the paper process path. The sensor is used to sense a position of a sheet in the paper path and to generate a signal indicative thereof. A pair of independently driven nips is located in the paper path for forwarding a sheet therealong. A controller receives signals from the sensor and generates motor control drive signals for the pair of independently driven nips. The drive signals are used to deskew and register a sheet at a registration position in the paper path.

FIGS. 1A and 1B depict an exemplary sheet registration device according to the known art. The sheet registration device 100 includes two nips 105, 110 which are independently driven by corresponding motors 115, 120. The resulting 2-actuator device embodies a simple registration device that enables sheet registration having three degrees of freedom. The under-actuated (i.e., fewer actuators than degrees of freedom) nature makes the registration device 100 a nonholonomic and nonlinear system that cannot be controlled directly with conventional linear techniques. The control for such a system, and indeed for each of the above described systems, employs open-loop (feed-forward) motion planning.

FIG. 2 depicts an exemplary open-loop motion planning control process according to the known art. One or more sensors, such as PE2, CCD1 and CCD2 shown in FIG. 1B, are used to determine an input position of the sheet 125 when the lead edge of the sheet is first detected by PE2 (as represented in FIG. 1B). An open-loop motion planner 205 interprets the information retrieved from the sensors as the input position and calculates a set of desired velocity profiles $\omega_d$ that will steer the sheet along a viable path to the final registered position if perfectly tracked (i.e., assuming that no slippage or other errors occur). One or more motor controllers 210 are used to control the desired velocities $\omega_d$. The one or more motor controllers 210 generate motor voltages $u_m$ for the motors 115, 120. The motor voltages $u_m$ determine the angular velocities $\omega$ at which each corresponding nip 105, 110 is rotated. For example, a DC brushless servo motor can be used to create a pulse width modulated voltage $u_{m1}$ to track a desired velocity $\omega_1$. Alternately, any of a stepper motor, an AC servo motor, a DC brush servo motor, and other motors known to those of ordinary skill in the art can be used. The sheet velocity at each nip 105, 110 is computed as the radius (c) of the drive roll multiplied by the angular velocity of the roll ($\omega_1$ for 105 and $\omega_2$ for 110). By matching the angular velocities of the nips 105, 110 to $\omega_d$, sheet registration can be achieved. Alternately, the motor controller 210 can include a feed-forward torque-based motor controller.

Although the sheet is not monitored for path conformance during the process, an additional set of sensors, such as PEL, CCDL and CCD1 in FIG. 1B, can be placed at the end of the registration system 100 to provide a snapshot of the output for adapting the motion planning algorithm. However, because path conformance is not monitored, error conditions that occur in an open-loop system may result in errors at the output that require multiple sheets to correct. In addition, although open-loop motion planning can be used to remove static (or "DC") sources of errors, the open-loop nature of the underlying motion planning remains vulnerable to changing (or "AC") sources of error. Accordingly, the sheet registration system may improperly register the sheet due to slippage or other errors in the system.

Systems and methods for improving the registration of misaligned sheets in a sheet registration system, for using a closed-loop feedback control system in a sheet registration system, for linearizing the inputs of a sheet registration system to the outputs to enable closed-loop feedback, and/or for scheduling gain in a sheet registration system to control the resulting nip forces and sheet tail wag within design constraints while converging the sheet to a desired trajectory within a pre-determined time would be desirable.

The present embodiments are directed to solving one or more of the above-listed problems.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "document" is a reference to one or more documents and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In an embodiment, a method for performing sheet registration may include identifying output values for a sheet within a reference frame, determining a difference between each output value and a corresponding desired output value, determining input values for the sheet based on at least the differences, determining state feedback values based on information received from the one or more sensors, and, for each of a plurality of drive rolls, determining an acceleration value based on the input values and the state feedback values, determining a desired angular velocity value based on the acceleration value, and determining a motor voltage for a motor for the drive roll that tracks an observed angular velocity value for the drive roll to the desired angular velocity value for the drive roll. The acceleration values may create a linear differential relationship between the input values and the output values. The above-listed steps may be performed a plurality of times.

In an embodiment, a system for performing sheet registration may include one or more sensors, a plurality of drive rolls, a plurality of motors and a processor. Each motor may be associated with at least one drive roll. The processor may include a state feedback determination module for determining state feedback values based on information received from the one or more sensors, an output value identification module for determining output values based on the state feedback values, a difference generation module for determining the difference between each output value and a desired value for each output value, an input value determination module for determining input values based on at least the differences, an acceleration value determination module for determining an acceleration value for each drive roll based on the input values and the state feedback values, an angular velocity determination module for determining a desired angular velocity value for each drive roll based on the acceleration value, and a motor voltage determination module for determining a motor voltage for each motor. The motor voltage determination module may track an observed angular velocity value for each drive roll to the desired angular velocity value for the drive roll. The acceleration values may create a linear differential relationship between the input values and the output values.

DESCRIPTION OF THE DRAWINGS

Aspects, features, benefits and advantages of the present invention will be apparent with regard to the following description and accompanying drawings, of which.

DETAILED DESCRIPTION

A closed-loop feedback control process may have numerous advantages over open-loop control processes, such as the one described above. For example, the closed-loop control process may improve accuracy and robustness. The inboard and outboard nips 105, 110 may be the two actuators for a sheet registration system. However, error between desired and actual sheet velocities may occur. Error may be caused by, for example, a discrepancy between the actual sheet velocity and an assumed sheet velocity. Current systems assume that the rotational motion of parts within the device, specifically the drive rolls that contact and impart motion on a sheet being registered, exactly determine the sheet motion. Manufacturing tolerances, nip strain and slip may create errors in the assumed linear relationship between roller rotation and sheet velocity. Also, finite servo bandwidth may lead to other errors. Even if the sheet velocity is perfectly and precisely measured, tracking error may exist in the presence of noise and disturbances. Error may also result as the desired velocity changes for a sheet.

The proposed closed-loop algorithm may take advantage of position feedback during every sample period to increase the accuracy and robustness of registration. Open-loop motion planning cannot take advantage of position feedback. As such, the open-loop approach may be subject to inescapable sheet velocity errors that lead directly to registration error. In contrast, the closed-loop approach described herein may use feedback to ensure that the sheet velocities automatically adjust in real-time based on the actual sheet position measured during registration. As such, the closed-loop approach may be less sensitive to velocity error and servo bandwidth and may be more robust as a result.

In addition, current open-loop algorithms may rely on teaming based on performance assessment to satisfy performance specifications. Additional sensors may be required to perform the learning process increasing the cost of the registration system. When a novel sheet is introduced, such as, for example, during initialization of a printing machine, when feed trays are changed, and/or when switching between two sheet types, "out of specification" performance may occur for a plurality of sheets while the algorithm converges. In some systems, the out of specification performance may exist for 20 sheets or more.

Figure 1A:
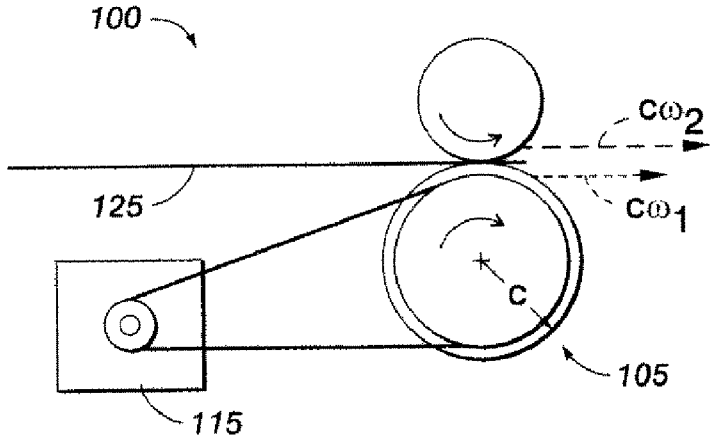
FIGS. 1A and 1B depict an exemplary sheet registration device according to the known art.
Figure 1B:
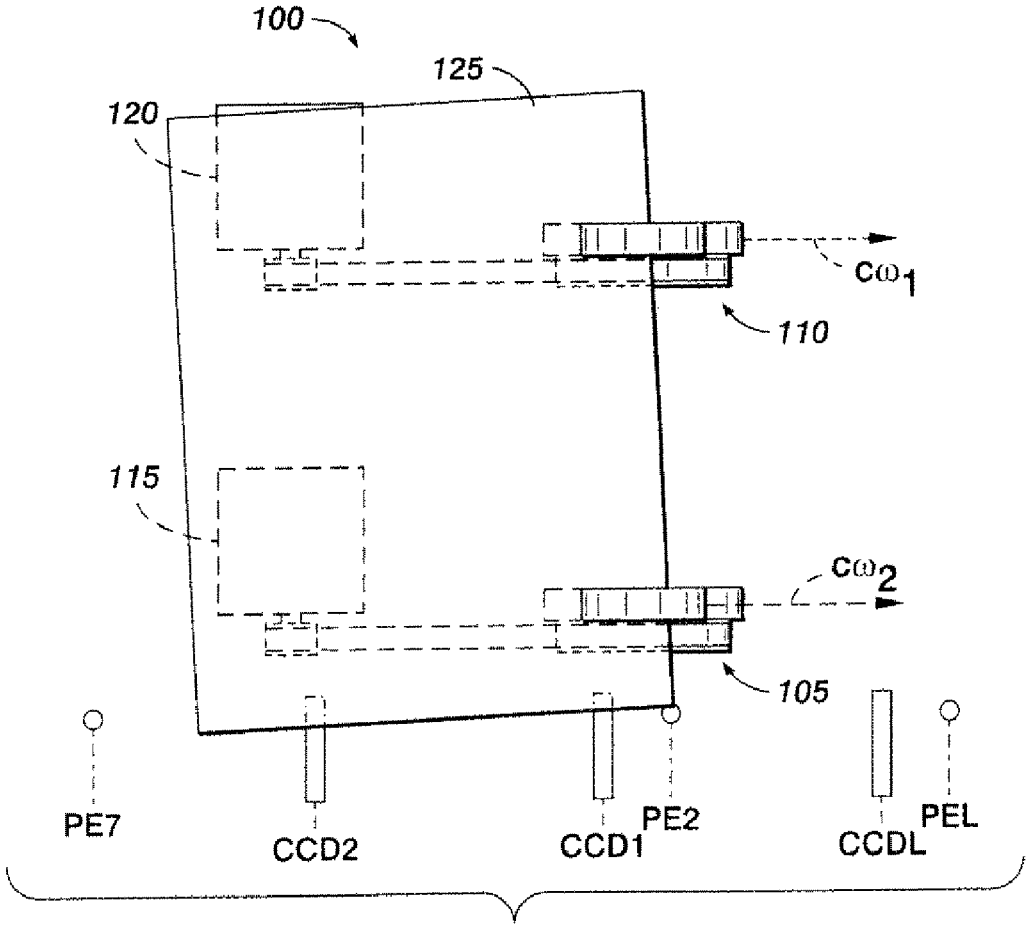
Figure 2:
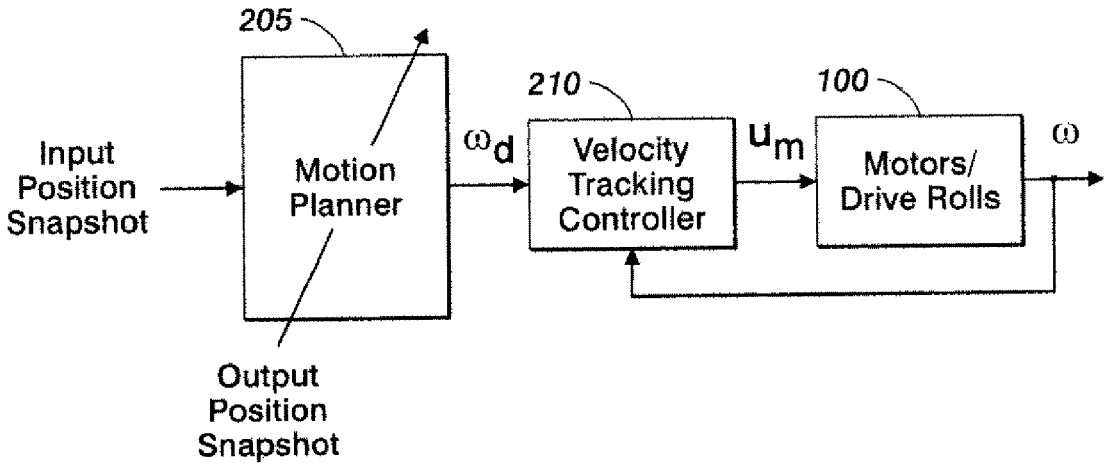
FIG. 2 depicts an exemplary open-loop motion planning control process according to the known art.
Figure 3:
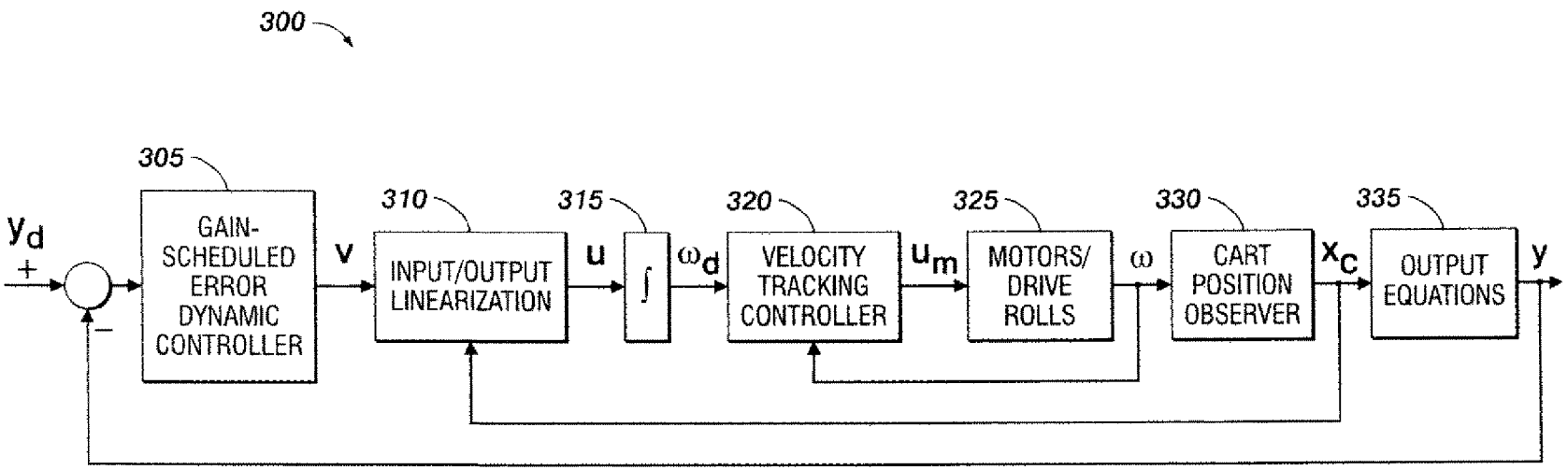
FIG. 3 depicts an exemplary closed-loop feedback motion planning control process according to an embodiment.

FIG. 3 depicts an exemplary closed-loop feedback motion planning control process according to an embodiment. The closed-loop control process 300 may use information retrieved from a sheet registration system, such as the system shown in FIGS. 1A and 1B, to register a sheet. Information retrieved from the sensors, such as CCD1, CCD2, CCDL, PE2, PEL and encoders on the roll shafts, may be used to determine a position and rotation of a sheet during the registration process. Other sheet registration systems, having more or fewer sensors that are placed in a variety of locations, may be used within the scope of the present disclosure, which is not limited to use with the system shown in FIGS. 1A and 1B.

Figure 4A:
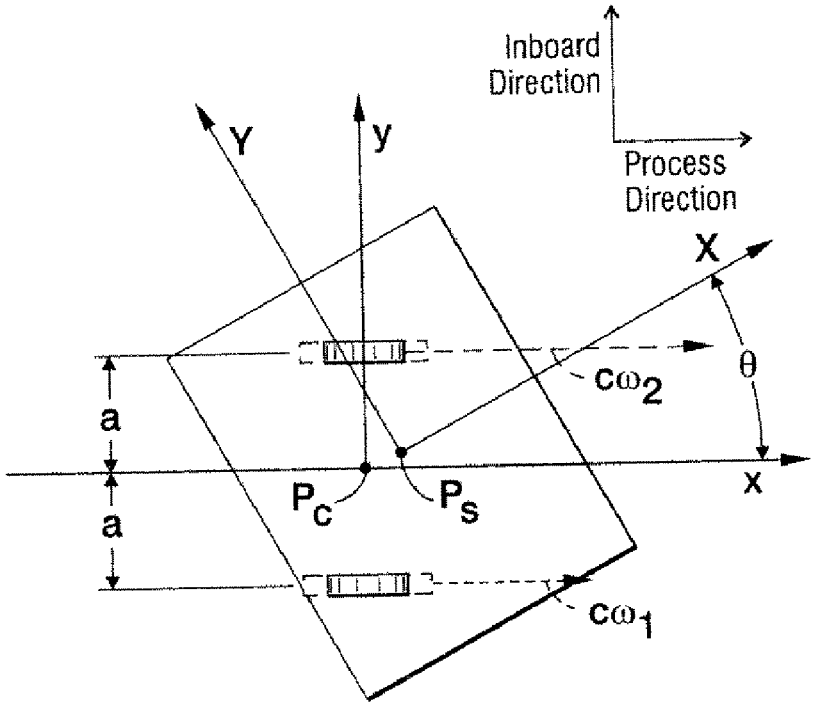
FIG. 4A depicts an exemplary reference frame based on the drive rolls.
Figure 4B:
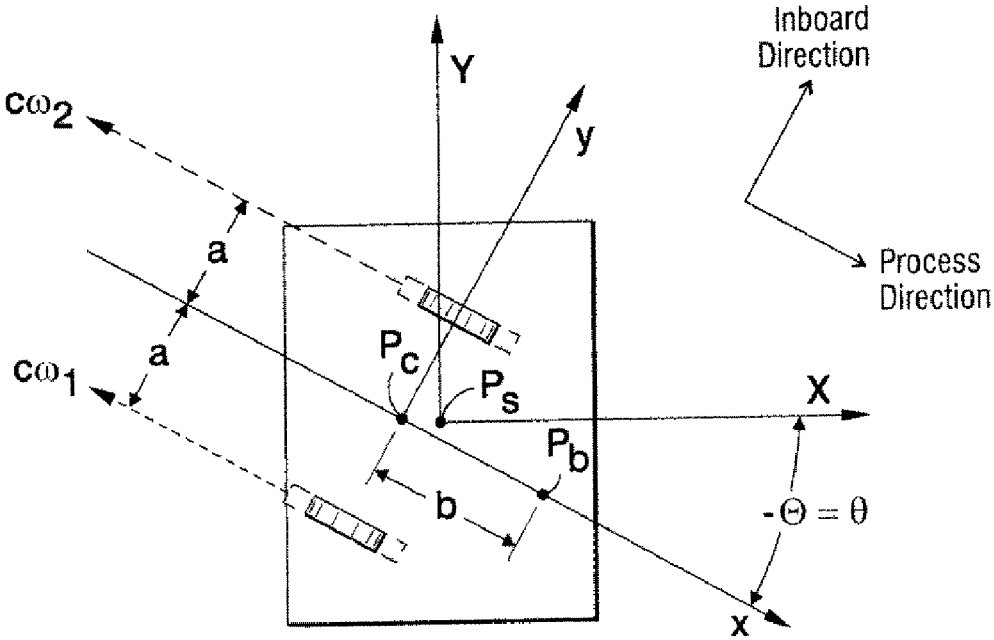
FIG. 4B depicts an exemplary reference framed based on the orientation of the sheet in the process according to an embodiment.

Referring back to FIG. 3, a reference frame may initially be selected (for example, as described below in reference to FIGS. 4A and 4B), and two outputs y may be selected based on the reference frame. A coordinate system is constructed within a reference frame (i.e., a perspective from which a system is observed) to analyze the operation of the sheet registration system. For example, the reference frame in FIG. 4A is selected based upon the orientation of the drive rolls (nips). In contrast, the reference frame in FIG. 4B is selected based upon the orientation of the sheet.

To be effective, the input-output linearization module 310 may require the selection of an appropriate reference frame. FIG. 4A depicts an exemplary reference frame based on the drive rolls, where the process direction (i.e., the direction that the sheet is intended to be directed) is defined to be the x-axis, and the y-axis is perpendicular to the x-axis in, for example, an inboard direction. A five dimensional state vector x may be defined in the basis of this reference frame:

$$x=[x\ y\ \theta\ \omega_1\ \omega_2]^T,$$

where: $\{x, y\}$ denote the coordinates of the center of mass of the sheet ($P_s$);

$\theta$ denotes the angle of the sheet relative to the x-axis; and $\{\omega_1, \omega_2\}$ denote the angular velocities of the outboard and inboard drive rolls, respectively.

The sheet states $q=[x\ y\ \theta]^T$ are a subset of state vector x. If no slip exists between the drive rolls and the sheet, three kinematic equations may relate the sheet states to the angular velocities:

$$\dot{\theta} = \frac{c(\omega_1 - \omega_2)}{2a},$$

-continued $$\dot{x} = \frac{c(\omega_1 + \omega_2)}{2} - y\dot{\theta}, \text{ and}$$

$$\dot{y} = x\dot{\theta},$$

where: c denotes the radius of the drive rolls; and 2a denotes the distance between the rolls as shown in FIG. 4A.

The fundamental goal of a sheet registration device may be to make a point on the sheet track a desired straight line path with zero skew at the process velocity. In the basis of the reference frame, this desired trajectory is described by:

$$x_d(t)=v_d t+x_{di},\ y_d(t)=y_{di}, \text{ and } \theta_d(t)=0,$$

where: $v_d$ denotes the process velocity; and $\{x_{di}, y_{di}\}$ describes the desired initial position of the center of mass of the sheet.

One problem with the reference frame shown in FIG. 4A is that input-output linearization cannot be applied because no two outputs y can be readily found in the basis of the frame that guarantee the convergence of the three sheet states q to the desired sheet trajectory. Accordingly, a different reference frame must be determined that can satisfy this requirement in order to provide closed-loop feedback linearization.

FIG. 4B depicts an exemplary reference frame based on the orientation of the sheet in the process according to an embodiment. The reference frame in FIG. 4B may incorporate a virtual body fixed to the drive rolls. The drive rolls and the virtual body may form a "cart" riding along the underside of the sheet to describe an XY reference frame. A five dimensional state vector may be defined with respect to the XY reference frame:

$$x_c=[X\ Y\ \Theta\ \omega_1\ \omega_2]^T,$$

where $\{X, Y\}$ denote the coordinates of the center of the cart ($P_c$);

$\Theta$ denotes the angle between the cart and the XY coordinate system; and $\{\omega_1, \omega_2\}$ denote the angular velocities of the outboard and inboard drive rolls, respectively. These angular velocities are common to state vector x within the xy frame.

The cart states may be defined as a subset of $x_c$, $q_c=[X\ Y\ \Theta]^T$. The transformations between the sheet and the cart states may be defined as:

$$X=-(x\cos\theta+y\sin\theta),\ Y=-(-x\sin\theta+y\cos\theta),\ \Theta=-\theta.$$

The cart and sheet orientations, $\Theta$ and $\theta$, may differ in sense because the cart "moves" in the opposite direction of the sheet. In other words, if the sheet were a surface on which the drive wheels propelled the virtual cart, the drive wheels would propel the cart in a direction substantially opposite from the process direction. By substituting these transformations into the desired sheet trajectory determined above, the desired cart trajectory that achieves sheet registration may be determined:

$$X_d(t)=-v_d t-x_{di},\ Y_d(t)=-y_{di}, \text{ and } \Theta_d(t)=0.$$

The outputs y may correspond to the position of a center of the virtual cart, which may be determined by using information retrieved from the one or more sensors. A set of desired outputs $y_d$ may also be determined. In an embodiment, the desired output values may correspond to the position of a point that is on a line bisecting the nips (wheels of the cart) 105, 110. In operation, the convergence of the outputs y to the desired outputs $y_d$ may guarantee convergence of the three sheet states (i.e., the two-dimensional position of the sheet and the rotation of the sheet with respect to a process direction) to the desired (registered) trajectory. The differences between the values of the desired outputs and the corresponding current output values may be used as inputs to a gain-scheduled error dynamics controller 305 that accounts for error dynamics. This controller 305 may have output values v.

Due to the limited amount of time available to perform registration, employing gain-scheduling or a variable set of gains within the error dynamics controller 305 may be a vital component in a sheet registration system employing closed-loop feedback control. Gain scheduling may be used, for example, by sheet registration systems in the presence of otherwise insurmountable constraints with, for example, a static set of gains. A gain schedule effectively minimizes the forces placed on a sheet while still achieving sheet registration. The gain-scheduled error dynamics controller 305 may perform this by, for example, starting with low gains to minimize the high accelerations characteristic of the early portion of registration and then increasing the gain values as the sheet progresses through the sheet registration system to guarantee convergence in the available time.

An input-output linearization module 310 may receive the outputs of the error dynamics controller 305 (v) and state feedback values $x_c$ to produce acceleration values u for the nips 105, 110. The state feedback values $x_c$ may include, for example, the position and rotation of the sheet and the angular velocities of each drive roll associated with a nip 105, 110. The sheet position and rotation may be determined based on sensor information from, for example, the sensors described above with respect to FIG. 1B or any other sensor configuration that can detect the orientation of a sheet. The angular velocity of each drive roll may be determined by, for example, encoders and/or sensors on the drive roll. The acceleration values u may be used to create a linear differential relationship between the inputs v and the outputs y of the closed-loop feedback control process.

Kinematic equations (based on an assumption of no slip) for the cart may include:

$$\dot{X}\cos\Theta+\dot{Y}\sin\Theta+a\dot{\Theta}+c\omega_1=0,\ \dot{X}\cos\Theta+\dot{Y}\sin\Theta-a\dot{\Theta}-c\omega_2=0,\ \text{and}\ \dot{Y}\cos\Theta-\dot{X}\sin\Theta=0,$$

which can be written in matrix form as:

$$\dot{q}_c = S(q_c)\omega(t)$$

where:

$$S(q_c) = \begin{bmatrix} \frac{1}{2}c\cos\Theta & \frac{1}{2}c\sin\Theta & \frac{c}{2a} \\ \frac{1}{2}c\cos\Theta & \frac{1}{2}c\sin\Theta & -\frac{c}{2a} \end{bmatrix}^T;\ \text{and}$$

$$\omega(t) = [\ \omega_1\ \ \omega_2\ ]^T.$$

Assuming a set of accelerations $u=[u_1\ u_2]^T$, the resulting cart state equations may be written in companion form:

$$\dot{x}_c = f(x_c) + G(x_c)u,$$

where:

$$f(x_c) = \begin{bmatrix} \underset{1\times3}{(S\omega)^T} & \underset{1\times2}{0} \end{bmatrix}^T,\quad G(x_c) = \begin{bmatrix} \underset{2\times3}{0} & \underset{2\times2}{I} \end{bmatrix}^T.$$

As with the angular velocities of the drive rolls ω, the accelerations of the drive rolls u may be common to the equations of both reference frames.

The position of a point $P_b$ (an exemplary $P_b$ is shown in FIG. 4B) may be selected to define the outputs y. $P_b$ may be used to assist in achieving linearization between the inputs and the outputs to the sheet registration system. The position of $P_b$ may be described in equation form as: $y=h(q_c)=[X_b\ Y_b]^T=[X+b\cos\Theta\ Y+b\sin\Theta]^T$. Substituting the desired trajectory of the cart into these equations may result in the corresponding desired output equations: $y_d=[y_{d_1}\ y_{d_2}]^T=[-v_d t-x_{di}+b-y_{di}]^T$. Convergence of outputs y to desired values $y_d$ may guarantee convergence of cart states $q_c$ to the desired cart trajectory, which in turn may guarantee the convergence of the sheet states q to the desired (registered) sheet trajectory.

In order to perform linearization between the inputs and the outputs, the output must be recursively differentiated until a direct relationship exists between the inputs and the outputs. Differentiating the outputs once provides the following:

$$\begin{aligned} \dot{y} &= \frac{d}{dt}h(x_c) \\ &= \nabla h(x_c)\dot{x}_c \\ &= \nabla h(x_c)(f+Gu) \\ &= L_f h + L_g h u \end{aligned}$$

where:

$$L_f h = \begin{bmatrix} L_f h_1 \\ L_f h_2 \end{bmatrix}\ \text{and}\ L_g h = \begin{bmatrix} L_{g_1} h_1 & L_{g_2} h_2 \\ L_{g_1} h_2 & L_{g_2} h_2 \end{bmatrix}.$$

Here, $\nabla h(x_c)$ denotes the Jacobian of $h(x_c)$. The Lie derivative of any scalar h with respect to any vector f is a scalar function defined by $L_f h=\nabla h f$ (essentially the directional derivative of h in an f space: $f\cdot\nabla h$). Evaluating the second term of the right hand side of the equation above results in $$L_g h = \begin{bmatrix} 0 & 0 \\ 0 & 0 \end{bmatrix},$$

which establishes that the first differentiation does not introduce the output. Differentiating a second time may provide the following equation:

$$\ddot{y} = \frac{d}{dt}\dot{y} = \nabla(L_f)h\dot{x}_c = L_f^2 h + L_g L_f h u = H + \Psi u,$$

where:

$$H = L_f^2 h = \begin{bmatrix} L_f^2 h_1 \\ L_f^2 h_2 \end{bmatrix}\ \text{and}$$

$$\Psi = L_g L_f h = \begin{bmatrix} L_{g_1} L_f h_1 & L_{g_2} L_f h_2 \\ L_{g_1} L_f h_2 & L_{g_2} L_f h_2 \end{bmatrix}.$$

In this case, $$\Psi = -\frac{c}{2a}\begin{bmatrix} a\cos\Theta - b\sin\Theta & a\cos\Theta + b\sin\Theta \\ b\cos\Theta + a\sin\Theta & -b\cos\Theta + a\sin\Theta \end{bmatrix}.$$

Both rows of $\Psi$ may be non-zero (i.e., each row contains at least one non-zero element). Accordingly, the value of at least one input may appear in both outputs after two differentiations. The determinant of $\Psi$ may be seen to be nonzero if b is nonzero: i.e., the decoupling matrix is non-singular. The inverse of $\Psi$ may be computed to be:

$$\Psi^{-1} = -\frac{1}{bc}\begin{bmatrix} -a\sin\Theta + b\cos\Theta & a\cos\Theta + b\sin\Theta \\ a\sin\Theta + b\cos\Theta & -a\cos\Theta + b\sin\Theta \end{bmatrix}.$$

An input v may be introduced, and u may be defined in terms of v as $u=\Psi^{-1}(v-H)$. u may be solved in closed form as:

$$\frac{1}{4a^2bc}\begin{bmatrix} 4a^2(-b\cos\Theta + a\sin\Theta)v_1 - 4a^2(a\cos\Theta + b\sin\Theta)v_2 + \\ c^2(\omega_1 - \omega_2)((a^2 - b^2)\omega_1 + (a^2 + b^2)\omega_2) \\ -4a^2(b\cos\Theta + a\sin\Theta)v_1 + 4a^2(a\cos\Theta - b\sin\Theta)v_2 - \\ c^2(\omega_1 - \omega_2)((a^2 + b^2)\omega_1 + (a^2 - b^2)\omega_2) \end{bmatrix}$$

Substituting u into the equation for $\ddot{y}$, the problem is reduced to the second order vector equation: $\ddot{y}=v$. This system is linear and uncoupled because each input $v_i$ only affects a corresponding output $y_i$.

Having reduced the problem to a linear form, the error e may be defined as $e=y_d-y$. The error dynamics may now be constructed by expressing v as a function of e and $y_d$: $v=\ddot{y}_d+k_d\dot{e}+k_pe$, which may be rewritten as: $\ddot{e}+k_d\dot{e}+k_pe=0$. Because these equations are uncoupled, the values of $k_{d_i}$ and $k_{p_i}$ (differential and proportional gain values for each drive roll) directly place the poles: $p_{1,2_i}=-k_d\pm\sqrt{k_{d_i}^2-4k_{p_i}}$. Choosing $k_{d_i}=2\sqrt{k_{p_i}}$, for example, may create critically damped error dynamics.

As the output error e converges to zero, the cart state error also converges to zero, but with a phase lag. The amount of phase lag between the convergence of the output and cart state may be adjustable via b. Using a smaller b may result in a smaller lag. In all, five parameters may be used to adjust the rate of convergence: the four gain values (the two-dimensional gain vectors $k_d$ and $k_p$) and the value of b.

If no system constraints existed, the gain parameters mentioned above ($k_d$, $k_p$ and b) would suffice to determine the control of the sheet. However, the time period for sheet registration is limited based on the throughput of the device. In addition, violating maximum tail wag and/or nip force requirements may create image quality defects. Tail wag and nip force refer to effects which may damage or degrade registration of the sheet. For example, excessive tail wag could cause a sheet to strike the side of the paper path. Likewise, if a tangential nip force used to accelerate the sheet exceeds the force of static friction, slipping between the sheet and drive roll will occur.

To satisfy the time constraints for a sheet registration system, high gain ($k_d$, $k_p$) values and a small value of b may be desirable. However, to limit the effects of tail wag and nip force below acceptable thresholds, small gain values and a large value of b may be required. Depending on the input error and machine specifications, a viable solution may not exist if the gain values are static.

In order to circumvent these constraints, gain scheduling may be employed to permit adjustment of the gain values during the sheet registration process. Relatively low gain values may be employed at the onset of the registration process in order to satisfy max nip force and tail wag constraints, and relatively higher gain values may be employed towards the end of the process to guarantee timely convergence. The gain values may be adjusted to maintain a consistent amount of damping. In an alternate embodiment, the damping may also be modified. Although the value of b is not technically a gain value, the value of b may also be scheduled to provide an additional degree of freedom.

Referring back to FIG. 3, for input-output linearization to be effective, accelerations u may be accurately tracked at the drive rolls 325. To achieve this, the accelerations u may be integrated 315 to produce the desired velocities $\omega_d$. One or more motor controllers 320 may be used to control the desired velocities $\omega_d$. The one or more motor controllers 320 may generate motor voltages $u_m$ for the motors that drive the drive rolls 325. The motor voltages $u_m$ may determine the angular velocities $\omega$ at which each corresponding drive roll 325 is rotated. For example, a DC brushless servo motor may be used to create a pulse width modulated voltage $u_{m1}$ to track a desired velocity $\omega_1$. In an alternate embodiment, any of a stepper motor, an AC servo motor, a DC brush servo motor, and other motors known to those of ordinary skill in the art can be used. The sheet velocity at each nip 105, 110 is computed as the radius (c) of the nip multiplied by the angular velocity of the nip ($\omega_1$ for 105 and $\omega_2$ for 110). The sheet velocity at each drive roll 325 may be defined as the radius (c) of the nip multiplied by the angular velocity of the drive roll. As shown in FIG. 3, each motor controller 320 may comprise a velocity controller. In an alternate embodiment, a feed-forward torque-based motor controller (not shown) may be used to control the torque exerted by the corresponding motor to track accelerations u directly.

The sheet velocity at each drive roll 325 may be defined as the radius (c) of the nip multiplied by the angular velocity of the drive roll. As shown in FIG. 3, each motor controller 320 may comprise a velocity controller. In an alternate embodiment, a torque controller (not shown) may be used to control the torque exerted by the corresponding motor.

The input-output linearization module 310 may utilize position feedback $x_c$ that is generated every sample period. An observer module 330 may employ the following kinematic equations for the cart to evolve the cart position $x_c$ based on the measured drive roll velocities $\omega$:

$$\dot{X} = \frac{-c(\omega_1 + \omega_2)}{2}\cos\Theta,$$

$$Y = \frac{-c(\omega_1 + \omega_2)}{2}\sin\Theta,$$

$$\dot{\Theta} = \frac{-c(\omega_1 - \omega_2)}{2a}.$$

The observer module 330 may be initialized by an input position snapshot provided by the sensors. Only the cart position may be needed because the reference frame for the linearization module 310 may be based on the cart state $x_c$. The cart state values $x_c$ may be converted to the corresponding sheet state values $q_c$ using, for example, a processor 335 to compute the equations defined above.

EXAMPLE

An exemplary sheet registration system designed according to an embodiment was installed in a Xerox iGen3® print engine. The input velocity of the sheets into the drive rolls was approximately 1.025 m/s. The registration was performed at a process velocity of approximately 1.024 m/s, which correlates to approximately 200 pages per minute. The process velocity reduces to a registration time of approximately 0.145 seconds, which is the time in which input-output linearization must converge in order to function properly in the system.

Figure 5A:
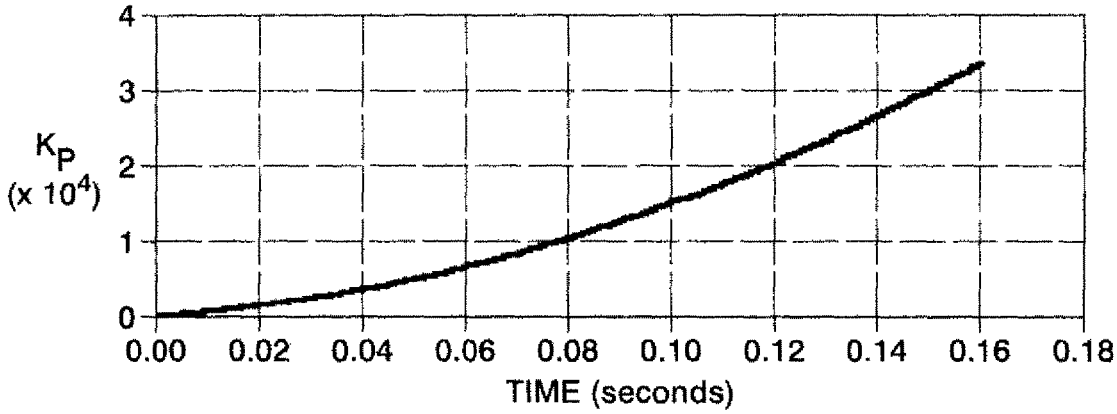
FIG. 5 depicts a graph of the scheduled gain values in an exemplary embodiment.
Figure 5B:
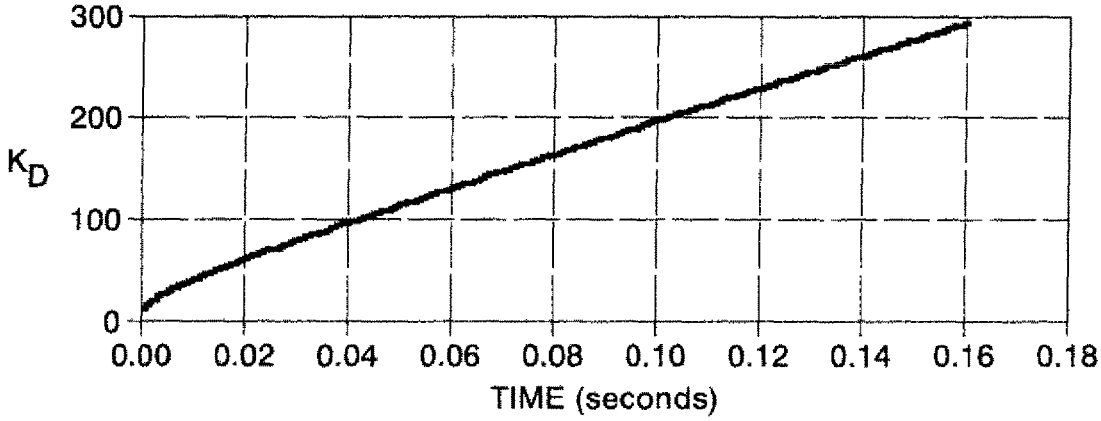

The sheet feeding mechanism was adjusted to produce approximately 5 mm of input lateral error. FIG. 5 depicts graphs of the gain values used to converge the sheet where a damping ratio of 0.7 is maintained in the exemplary embodiment. For the gain values show in FIG. 5, the value for b was maintained at −10 mm.

Figure 6:
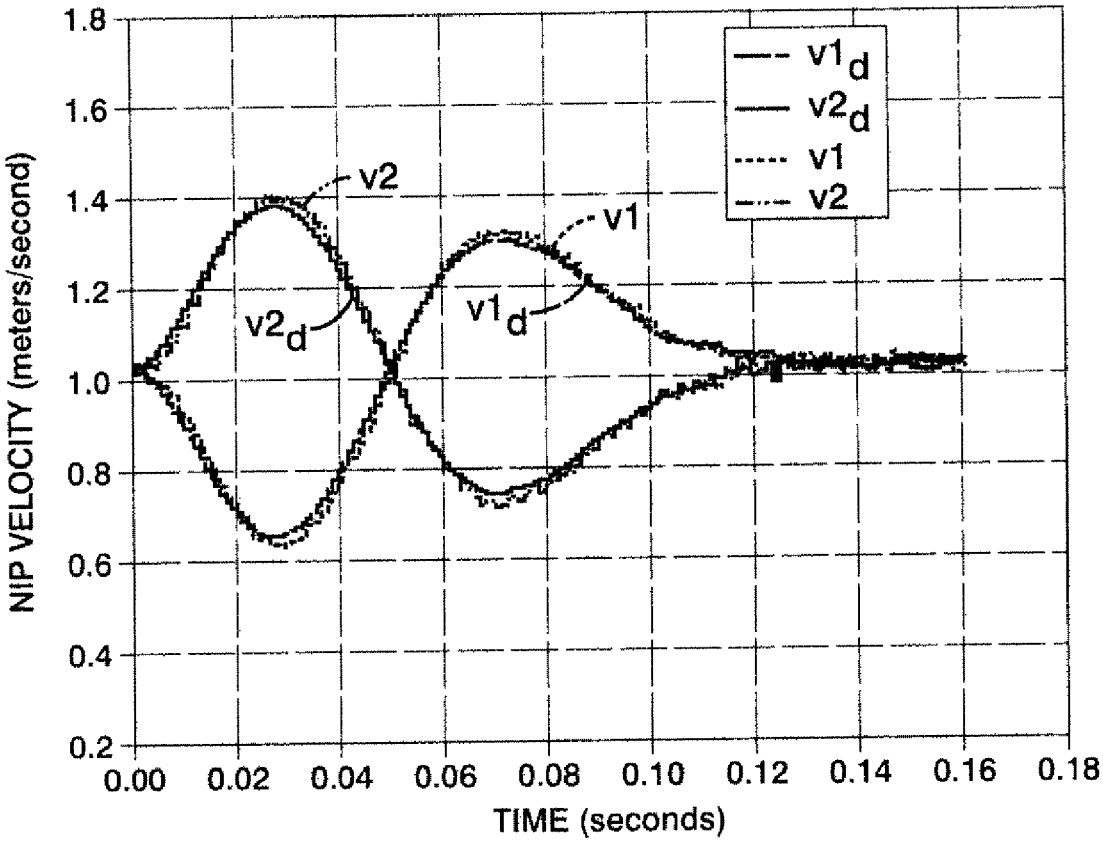
FIG. 6 depicts a graph of the nip velocities for each nip in an exemplary embodiment.

FIG. 6 depicts a graph of the nip velocities for each nip. As shown in FIG. 6, the desired angular velocities for each drive roll and the actual angular velocities for each drive roll produced by the sheet registration system may be substantially the same.

Figure 7:
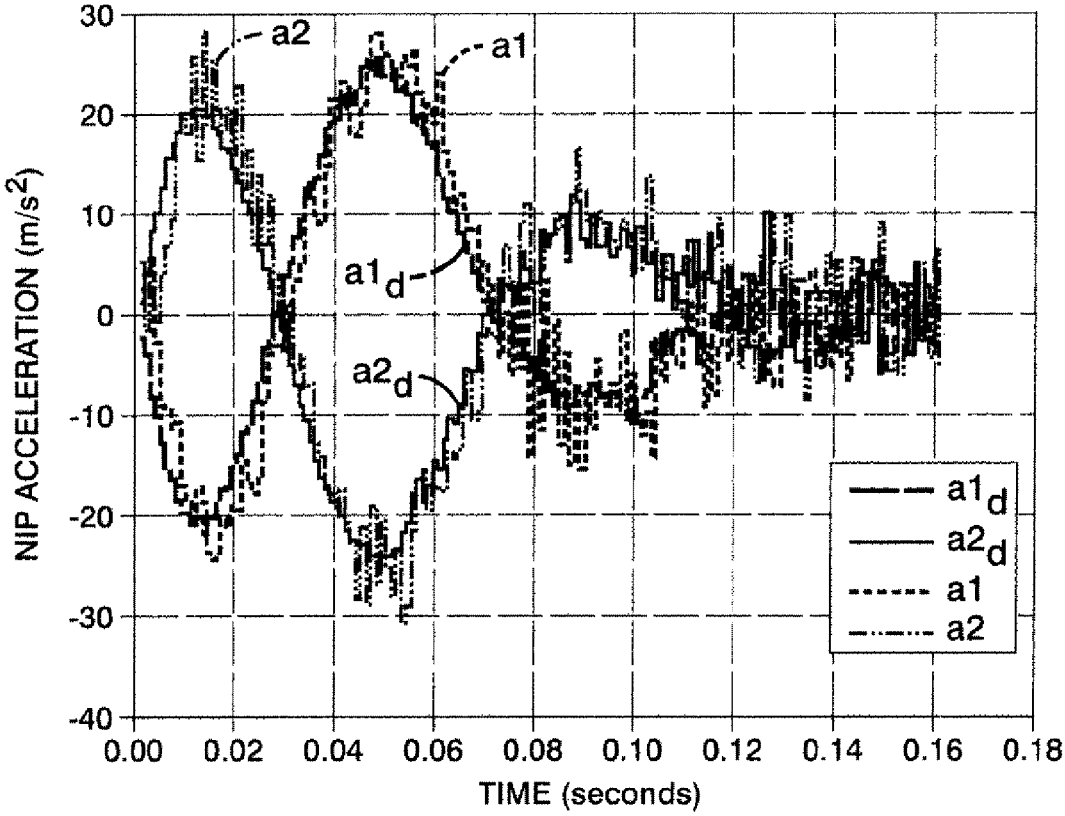
FIG. 7 depicts a graph of the nip accelerations for each nip in an exemplary embodiment.
Figure 8:
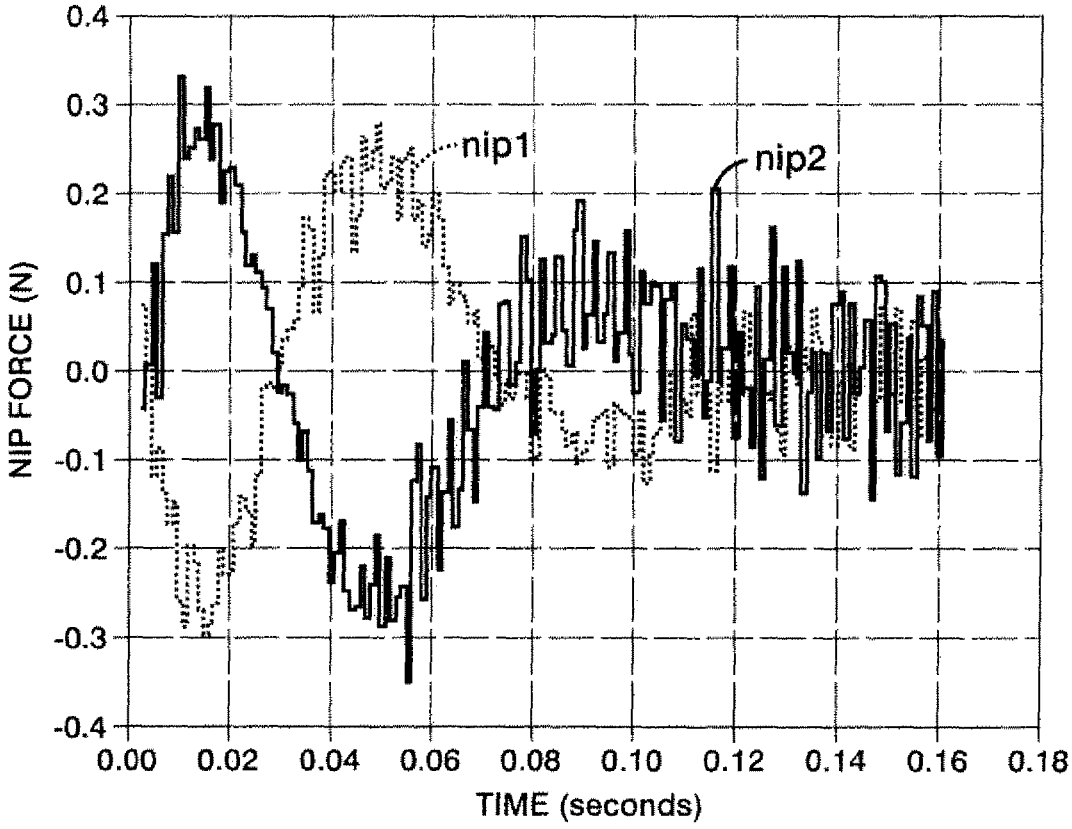
FIG. 8 depicts a graph of the nip forces for each nip in an exemplary embodiment.

FIG. 7 depicts a graph of the nip accelerations for each nip. FIG. 8 depicts a graph of the nip forces for each nip. Each of the nip accelerations and the tangential nip forces were filtered via a moving average filter to reduce the noise in the plot. As shown in FIGS. 7 and 8, the desired accelerations and forces closely matched the actual accelerations and forces for the sheet registration system.

Figure 9:
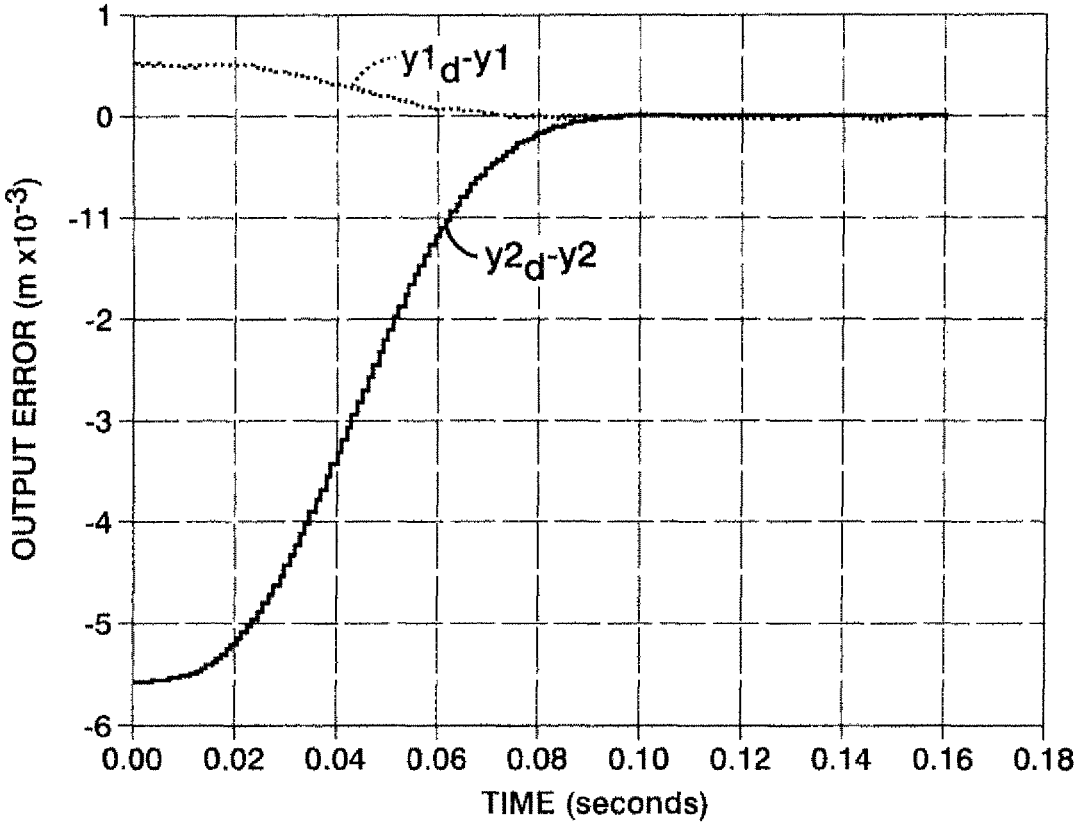
FIG. 9 depicts a graph of the output error for the virtual cart in an exemplary embodiment.
Figure 10A:
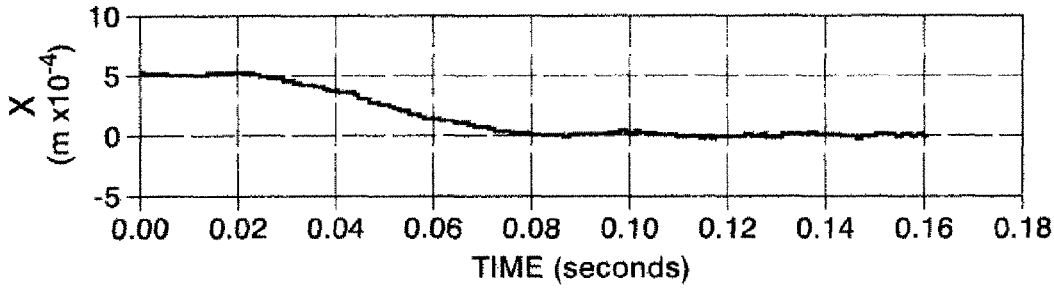
FIGS. 10A-C depict graphs of the error for the X, Y and Θ states for the cart in an exemplary embodiment.
Figure 10B:
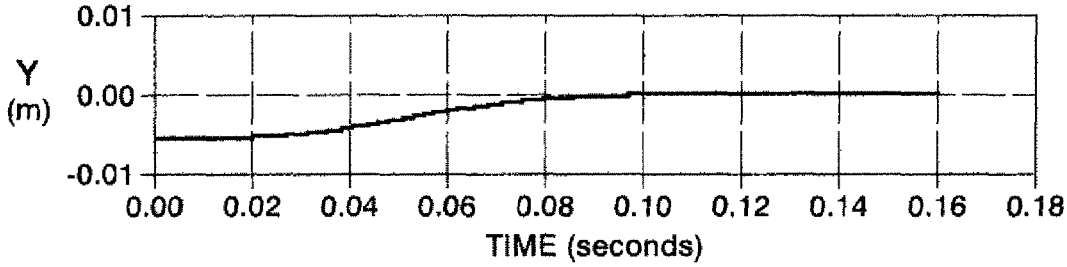
Figure 10C:
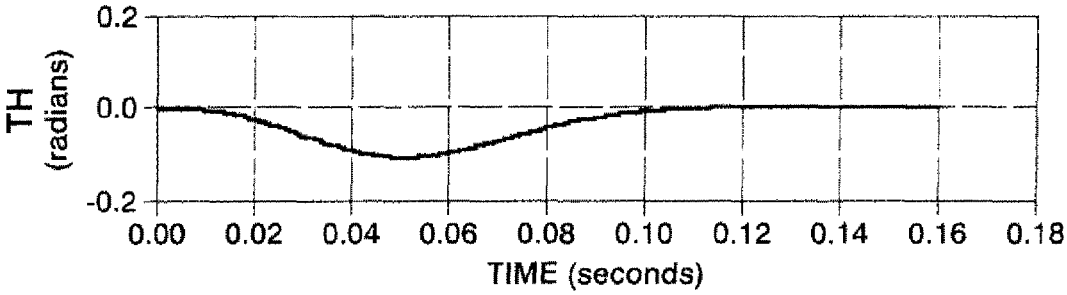

FIG. 9 depicts a graph of the output error for the virtual cart. As shown in FIG. 9, the cart outputs asymptotically converged to the desired values via the input-output linearization process. Moreover, this convergence occurred within 100 ms, which is substantially less than the 145 ms limit based on the system constraints. The convergence of the cart outputs may guarantee the convergence of the cart states as depicted in FIGS. 10A-C, which depicts graphs of the error for the X, Y and Θ states for the cart, respectively. In the results depicted in FIGS. 10A-C, the Y and Θ states converged approximately 20 ms later than the X state. The delay for the Y and Θ states may be largely attributed to the time that it takes $P_c$ to converge to the desired trajectory after $P_b$ has converged.

Figure 11A:
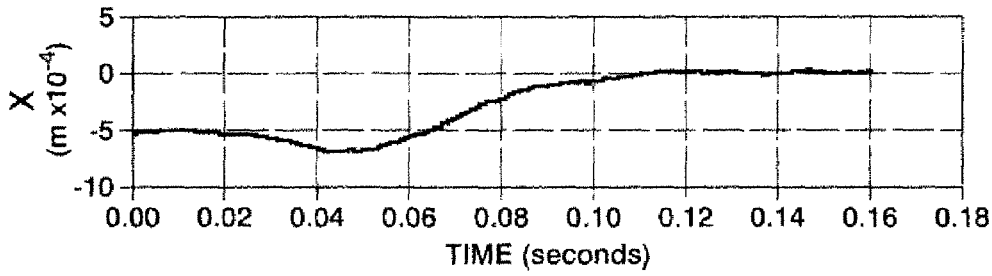
FIGS. 11A-C depict graphs of the error for the x, y, and θ states for the sheet in an exemplary embodiment.
Figure 11B:
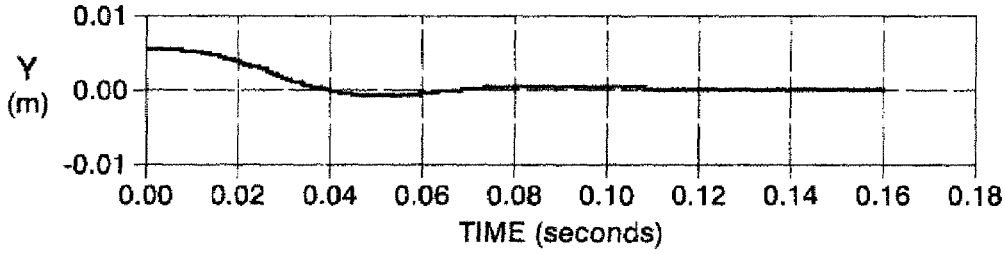
Figure 11C:
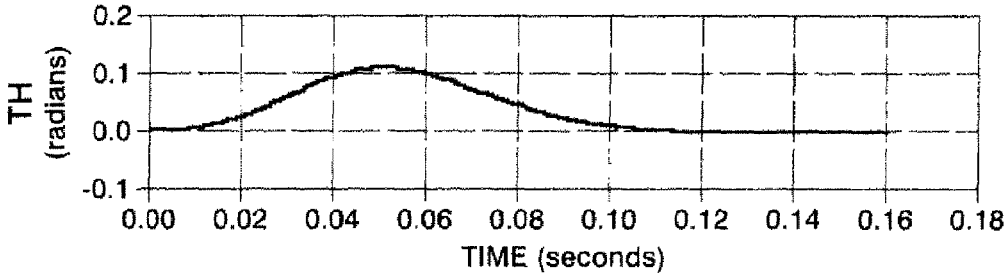

FIGS. 11A-C depict graphs of the error for the x, y, and θ states for the sheet, respectively. FIGS. 11A-C were generated by transforming the cart states to the sheet states via the equations defined above. Again, the convergence of the sheet is depicted in FIGS. 11A-C in approximately 100 ms.

Figure 12:
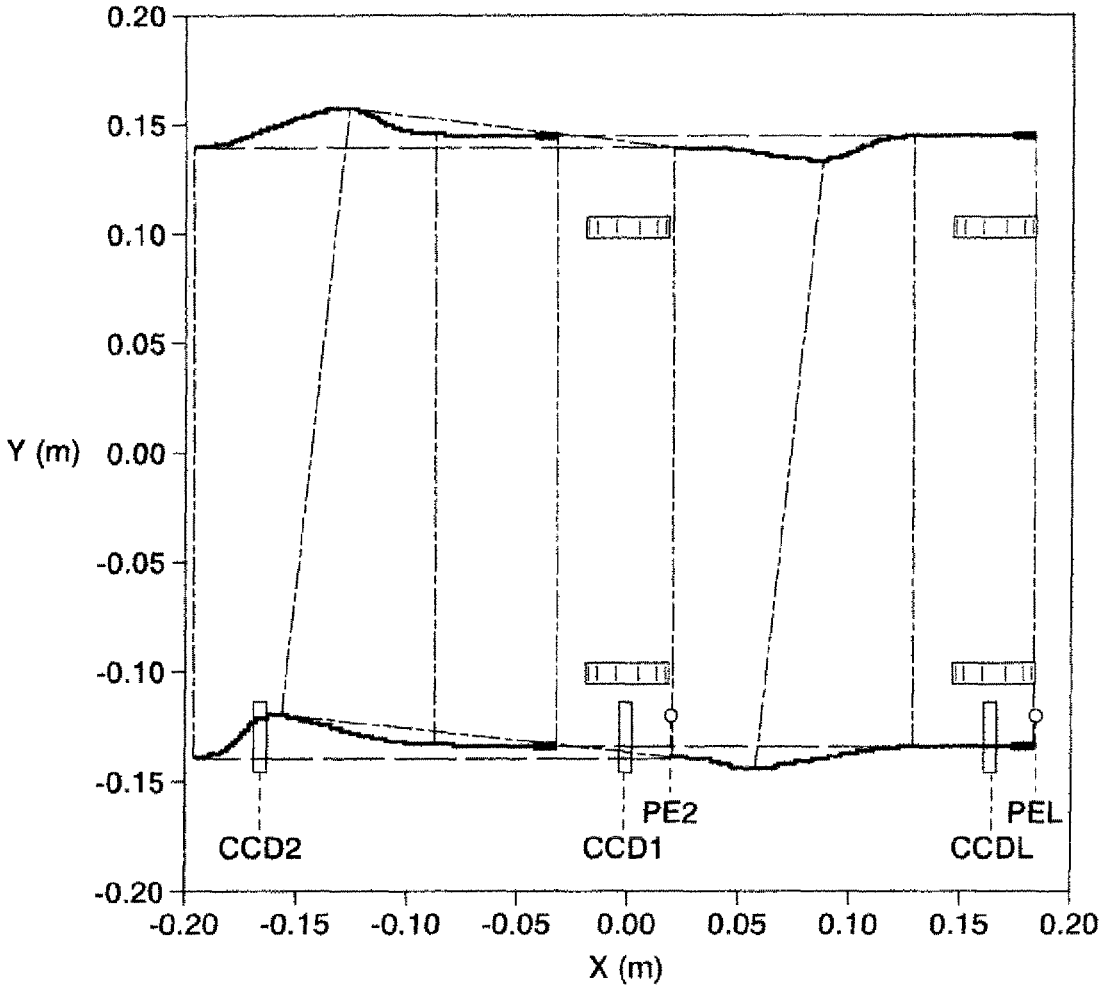
FIG. 12 depicts a graph of the sheet position as it traverses through a sheet registration system in an exemplary embodiment.

FIG. 12 depicts a graph of the sheet position as it moved through the sheet registration system. As shown in FIG. 12, the sheet's corners were determined based on sensor information and plotted as the sheet passes through the sheet registration system (from left to right). FIG 12 depicts the outline of the sheet for four sample periods during the registration process. The first sample period is the input position snapshot. The CCD sensors, the process edge (PE) sensors and the drive rolls are included in FIG. 12 to provide a frame of reference for the sheet position. The drive rolls are also included to show that the paper is registered before entering the pre-transfer nip.

Figure 13A:
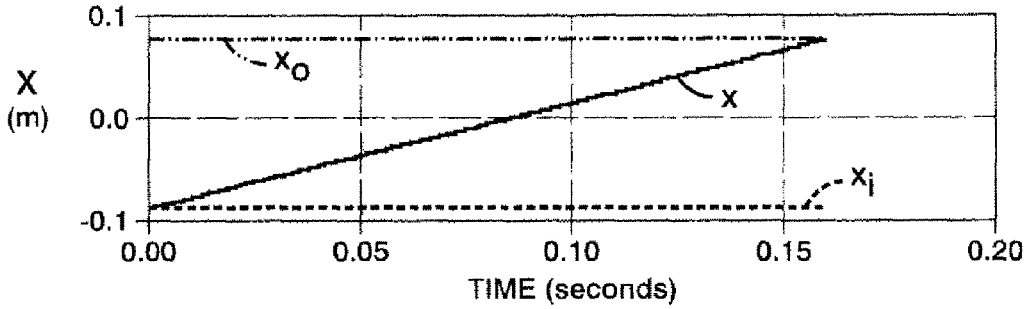
FIGS. 13A-C depict the observed sheet states as compared with the input and output snapshots in an exemplary embodiment.
Figure 13B:
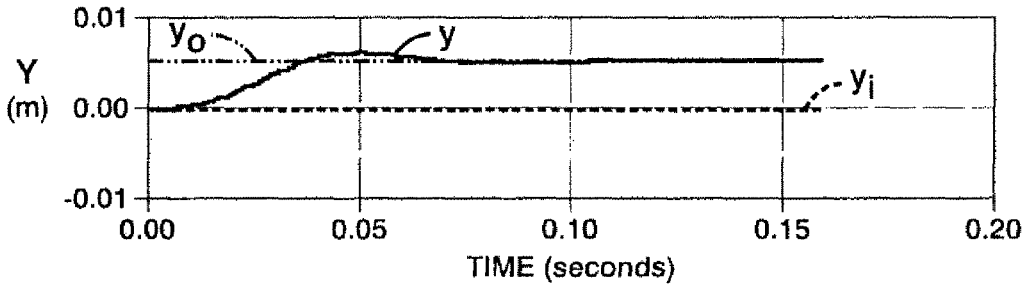
Figure 13C:
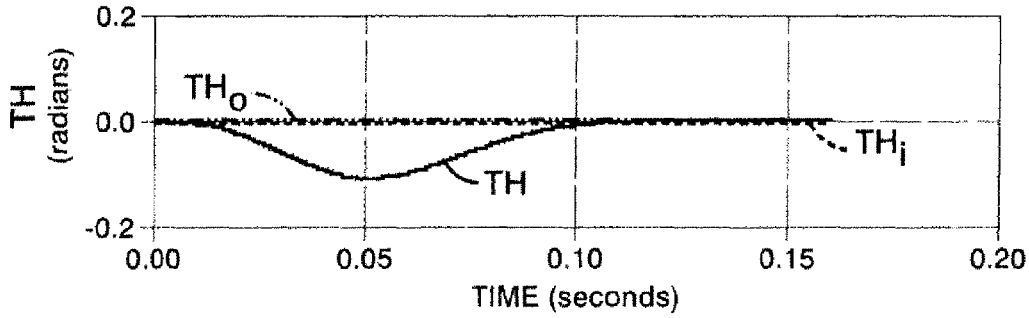

FIGS. 13A-C depict the observed sheet states as compared with the input and output snapshots. The input position snapshot may initialize the observer. Accordingly, no error exists at the start. The position of the cart may then be estimated by the encoders on the drive rolls. The accumulation of error may be summarized by the difference between the observed states and the output snapshot at the end of registration.

Figure 14:
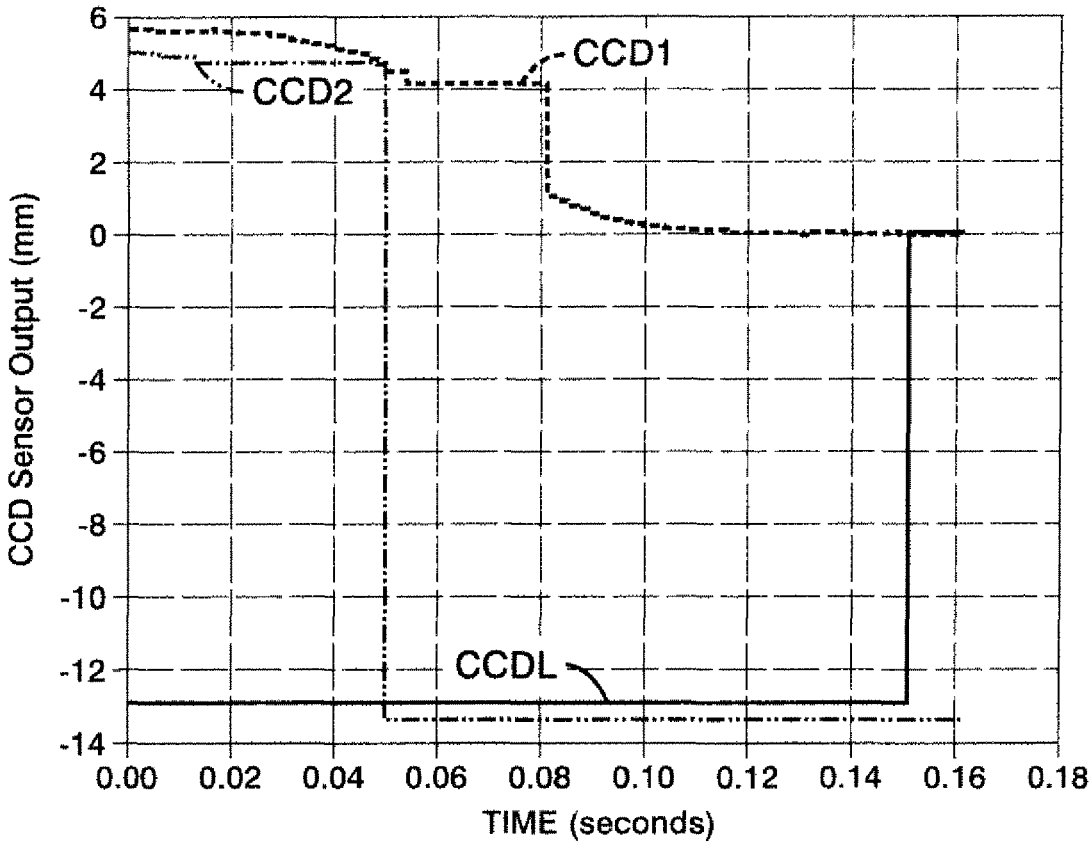
FIG. 14 may show the edge sensor readings during the sheet registration process in an exemplary embodiment.

FIG. 14 may show the CCD (lateral edge sensor) readings during the sheet registration process. A zero CCD reading indicates a desired (i.e., perfectly registered) location of the lateral edge of the sheet. Rising edges in FIG. 14 indicate sheet arrival, and falling edges indicate sheet departure. CCD1 and CCD2 are used for the input snapshot and CCD1 and CCDL are used for the output snapshot. Separation of CCD readings may result from sheet skew (i.e., Θ error).

The numerical results for the sheet state error are depicted in Table 1.

| | $x - x_d$ | $y - y_d$ | $\theta - \theta_d$ |
|---|---|---|---|
| Input state error | 0.535013 mm | −5.626886 mm | −3.985442 mrad |
| Output state error (observed) | −0.006469 mm | 0.000699 mm | 0.054475 mrad |
| Output state error (actual) | −0.312800 mm | −0.056000 mm | −0.169594 mrad |

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A method of aligning a sheet in a printing device in process, lateral and skew directions, comprising:

receiving a sheet by a device comprising a plurality of drive rolls, wherein each drive roll has a velocity;

selecting a first reference frame fixed with the drive rolls and a corresponding reference state vector for the sheet, wherein the reference state vector for the sheet comprises coordinates of a point on the sheet, an angle of the sheet, and angular velocities of the drive rolls;

identifying a desired trajectory for the sheet with respect to the first reference frame;

identifying a cart comprising the drive rolls and a virtual body having dimensions relating to the drive rolls, wherein the sheet serves as a surface on which the cart rides, wherein a direct relationship exists between the motion of the cart with respect to the sheet and the motion of the sheet with respect to the drive rolls;

selecting a second reference frame fixed with the sheet and a corresponding reference state vector for the cart, wherein the reference state vector for the cart comprises coordinates of a point on the cart, an angle of the cart, and angular velocities of the drive rolls;

determining a desired cart trajectory based on the desired trajectory for the sheet and the second reference frame;

adjusting the velocity of at least one drive roll based on the reference state vector for the cart and the desired cart trajectory; and repeating the determining and adjusting a plurality of times so that the sheet tracks the desired trajectory for the sheet.

2. The method of claim 1, wherein the device is a printing device, and the sheet comprises material onto which the device will apply a print element.

3. The method of claim 1, wherein the drive rolls for which the state vector of the cart includes angular velocities comprise inboard and outboard drive rolls.

4. The method of claim 1, wherein the adjusting comprises:

determining a desired roll velocity for at least one selected drive roll; and changing a voltage delivered to a motor that operates the selected drive roll so that the selected drive roll achieves the desired roll velocity.

5. The method of claim 1, wherein the adjusting is further based on the application of a gain at a scheduled position.

6. The method of claim 5, wherein more gain is applied as the sheet moves closer to an exit point of the device.

7. The method of claim 1, wherein the determining is repeated a plurality of times until the sheet reaches an exit point of the device.

8. A system for aligning a sheet in process, lateral and skew directions, comprising:

a transport module for receiving a sheet, wherein the transport module comprises a plurality of drive rolls, wherein each drive roll has a velocity;

a sensor module for determining a current position of the sheet;

a reference determination module for selecting a first reference frame fixed with the drive rolls and a corresponding reference state vector for the sheet, wherein the reference state vector for the sheet comprises coordinates of a point on the sheet, an angle of the sheet, and angular velocities of the drive rolls;

a trajectory module for determining a desired trajectory for the sheet with respect to the first reference frame;

a cart determination module for identifying a cart, selecting a second reference frame fixed with the sheet and a corresponding reference state vector for the cart, wherein the reference state vector for the cart comprises coordinates of a point on the cart, an angle of the cart, and angular velocities of the drive rolls, and identifying a desired cart trajectory, the cart comprising the drive rolls and a virtual body having dimensions relating the drive rolls, wherein the sheet serves as the surface on which the cart rides, wherein a direct relationship exists between the motion of the cart with respect to the sheet and the motion of the sheet with respect to the drive rolls, wherein the desired cart trajectory is based on the desired trajectory for the sheet and the second reference frame;

one or more motors, wherein each motor is capable of adjusting the velocity of at least one drive roll based on the reference state vector for the cart and the desired cart trajectory; and wherein the sensor module is configured to determine the position of the sheet a plurality of times and the one or more motors are configured to adjust the velocity of at least one drive roll a plurality of times so that the sheet tracks the desired trajectory for the sheet.

9. The system of claim 8, further comprising:

a print element for printing information on the sheet once the sheet has at least substantially passed through the transport module.

10. The system of claim 8, wherein the drive rolls for which the state vector of the cart includes angular velocities comprise inboard and outboard drive rolls.

11. The system of claim 8, further comprising:

a motor controller for determining a desired roll velocity for at least one selected drive roll, wherein the motor controller changes a voltage delivered to a motor that operates the selected drive roll so that the selected drive roll achieves the desired roll velocity.

12. The system of claim 8, further comprising:

a gain controller for adjusting a gain applied at a scheduled position.

13. The system of claim 12, wherein the gain controller is configured to apply more gain as the sheet moves closer to an exit point of the transport module.

14. The system of claim 8, wherein the sensor module is configured to determine the position of the sheet a plurality of times until the sheet reaches an exit point of the transport module.

15. The system of claim 8, wherein the sensor module comprises one or more sensors.

* * * * *